United States Patent [19]

Hikino et al.

[11] 4,426,570

[45] Jan. 17, 1984

[54] INFRARED RADIATIVE BODY AND A METHOD FOR MAKING THE SAME

[75] Inventors: Tadashi Hikino, Ikoma; Ikuo Kobayashi; Takeshi Nagai, both of Nara, all of Japan

[73] Assignee: Matsushita Electric Industrial Co., Ltd., Japan

[21] Appl. No.: 275,221

[22] Filed: Jun. 19, 1981

[30] Foreign Application Priority Data

Jul. 9, 1980 [JP] Japan ..... 55-94487
Sep. 5, 1980 [JP] Japan ..... 55-123746

[51] Int. Cl.[3] ..... H05B 3/10; F24H 3/00

[52] U.S. Cl. ..... 219/354; 219/353; 219/553; 250/504 R; 250/503.1

[58] Field of Search ..... 219/347, 464, 354, 353, 219/553; 250/503.1, 504, 493.1; 313/112

[56] References Cited

U.S. PATENT DOCUMENTS

| | | | |
|---|---|---|---|
| 1,385,608 | 7/1921 | Darrah | 219/354 |
| 1,531,414 | 3/1925 | Ruben | 219/354 |
| 2,007,111 | 7/1935 | Morgan | 219/354 |
| 2,658,984 | 11/1953 | Mohn | 219/354 |
| 3,195,004 | 7/1965 | Hassett | 219/354 |

*Primary Examiner*—B. A. Reynolds
*Assistant Examiner*—Teresa J. Walberg
*Attorney, Agent, or Firm*—Wenderoth, Lind & Ponack

[57] ABSTRACT

An infrared radiative body which is composed of a transparent refractory body and a refractory film thereon which absorbs visible and near-infrared radiation suitable for application in an infrared radiating apparatus such as a stove or oven, and a method for making the same.

2 Claims, 4 Drawing Figures

INFRARED RADIATIVE BODY AND A METHOD FOR MAKING THE SAME

BACKGROUND OF THE INVENTION

1. Field of the Invention

This invention relates to an infrared radiative body used for an infrared radiating apparatus such as a stove or oven and to a method for making the same.

2. Description of the Prior Art

Heretofore the infrared radiative body has usually been made of transparent refractory material such as fused quartz, glass and glass-ceramic.

The prior art infrared radiating body is transparent to visible, near-infrared and infrared radiation. But it is well known that visible and near-infrared radiation is not effective to heat most organic materials such as organic paints, foods, and the human body.

Therefore it is desirable that the infrared radiative body be transparent to infrared radiation and opaque to near-infrared and visible radiation.

SUMMARY OF THE INVENTION

Object of the Invention

According to the present invention we provide an infrared radiative body which is composed of a transparent refractory body and a refractory film thereon which absorbs visible and near-infrared radiation.

Further according to the present invention we provide a method of making a refractory film which absorbs visible and near-infrared radiation on the transparent refractory body.

DESCRIPTION OF THE PREFERRED EMBODIMENT

Usually the infrared radiative element is composed of a radiative body and a heating source.

Figure 1:
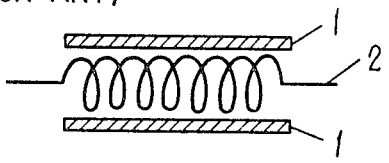
Fig. 1 (PRIOR ART)
FIG. 1 shows the cross-section of the infrared radiative element of the prior art composed of the radiative body (1) and heating source (2).

For example, FIG. 1 shows the cross-section of the infrared radiative element commonly used for stoves and ovens.

In this figure, (1) is the radiative body and (2) is the heating source. The surface of the radiative body of the prior art composed of transparent refractory material is not coated with other materials.

Therefore almost the entire radiation from the heating source passes through the radiative body.

Visible and near-infrared radiation which passes through the radiating body is not effective to warm up most organic materials.

Figure 2:
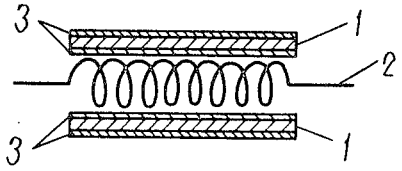
FIGS. 2 and 3 show the cross-section of the infrared radiative element composed of the radiative body of the present invention (1)–(3) and heating source (2).
Figure 3:
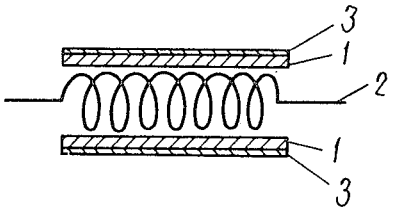

FIGS. 2 and 3 show the cross-section of the infrared radiative element composed of the radiative body according to the present invention and heating source.

In these figures, (1) is the transparent refractory body selected from the group consisting of fused-quartz, glass, glass-ceramic, alumina, magnesia, and titania.

Figure 4:
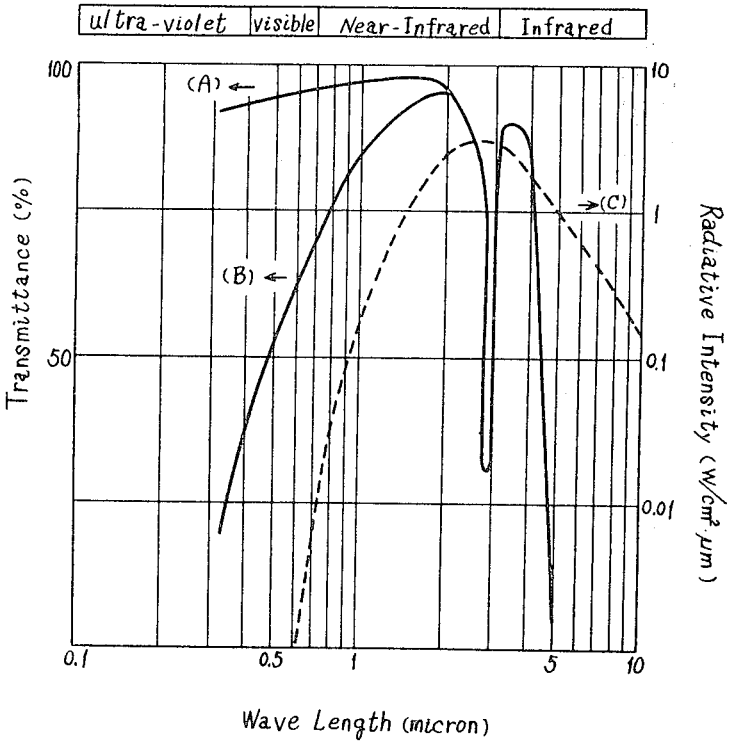
FIG. 4 shows the transmittance of fused quartz and that of fused quartz coated with ferric-oxide in the visible, near-infrared and infrared, and the radiative intensity of the heater at 900° C.

(3) is the refractory film which absorbs visible and near-infrared radiation and transmits infrared radiation of wavelength 3~4 microns as shown in FIG. 4, selected from the oxides of cobalt, copper, iron, nickel, manganese, molybdenum, tungsten, lanthanum, antimony, bismuth, vanadium, or zirconium or aluminum titanate.

According to the present invention, refractory film (3) absorbs visible and near-infrared radiation from the heat source (2) and transmits infrared radiation of wavelength 3~4 microns as shown in FIG. 4.

The effect of the present invention is measured by thermography (thermograph manufactured NIHON DENSHI LTD. JTG-IBL), which measures the intensity of infrared radiation and indicates in temperature.

The operable thickness of the refractory film (3) is 0.02–0.5 microns.

If the thickness of the refractory film exceeds 0.5 microns, the film cracks under heat shock and if it is below 0.02 microns, almost visible and near-infrared radiation pass through the transparent refractory body.

Further in this invention, the method for making the above-described infrared radiative body is described. According to the present invention, above-described infrared radiative body is made by coating the surface of the transparent refractory body with a thin continuous refractory film which absorbs visible and near-infrared radiation and transmits infrared radiation of wavelength 3~4 microns as shown in FIG. 4.

The refractory oxide film may be applied in several ways, e.g. by coating the refractory base with an organo-metallic compound and then firing to form the corresponding metal oxide, vacuum evaporative deposition of the metal followed by firing to form the oxide, sputtering the metal oxide coating on the refractory base or painting the refractory base with a paint containing the metal oxide in pigment form and said paint including a binder e.g. sodium silicate.

The invention is illustrated by the following examples. The examples describe a tubular body which is commonly used in electric stoves and electric ovens. Our invention is not limited by the examples, unless otherwise specified, but rather is construed broadly within its spirit and scope as set out in the appended claims.

EXAMPLE 1

A body transparent tubular fused quartz (external diameter: 10 mm, internal diameter: 8 mm, length: 250 mm) was cleaned by exposing it to Freon 113 vapor (manufactured by DuPont Corporation).

The tube was coated with an organometallic compound i.e. by immersion in a solution composed of 45 weight percent iron naphthenate, dissolved in mineral spirits, and 55 weight percent butyl acetate and was then withdrawn from the solution.

The tube coated with the iron naphthenate was fired at 600° C. for 15 minutes in an electric furnace.

The cross-section of the tube coated with the continuous ferric oxide film of 0.2 microns thickness was the same as in FIG. 2.

Numeral (1) of FIG. 2 corresponds to the transparent tubular fused quartz and (3) corresponds to the ferric oxide film.

A curled metal wire heater (2) of FIG. 2 was inserted in the prepared tube and 400 watts of electric power was supplied to the heater.

The surface temperature of the tube measured by the thermograph increases from 480° C. (before coating) to 515° C. (after coating).

FIG. 4 shows the transmittance curve of the fused quartz (thickness: 1mm) (A) and the transmittance curve of the fused quartz coated with the ferric oxide film (thickness: 0.2 microns) (B) and the radiation curve of the heater at 900° C. (C).

It was determined from these curves that the increase of the surface temperature of the tube was caused by absorbing visible and near-infrared radiation from the heater by the ferric oxide film.

EXAMPLE 2

A transparent tubular glass-ceramic (external diameter: 10 mm, internal diameter: 8 mm, length: 250 mm) was cleaned by immersion in trichloroethane and was withdrawn from the solvent.

The tube was coated with an organometallic compound by immersion in a solution composed of 35 weight percent iron- naphthenate dissolved in mineral spirits, 10 weight percent zirconium naphthenate dissolved in mineral spirit and 55 weight percent butyl acetate and was then withdrawn from the solution.

The tube coated with the mixture of iron naphthenate and zirconium naphthanate was fired at 650° C. for 15 minutes in an electric furnace.

The cross-section of the tube coated with a continuous iron-zirconium complex oxide film of 0.2 microns thickness was the same as in FIG. 3.

A curled metal wire heater (2) of the FIG. 3 was inserted in the prepared tube and electric power of 400 watts was supplied to the heater.

The surface temperature of the tube measured by the thermograph increases from 485° C. (before coating) to 520° C. (after coating).

EXAMPLE 3

A transparent tubular fused quartz (same size as Example 1) was cleaned by exposure to the Freon 113 vapor.

The tube was coated with copper in a vacuum evaporation apparatus. To form a continuous film around the tube, the tube was rotated at the rate of 60 r.p.m. during vacuum evaporation.

The thickness of the copper film was 0.2 microns and the surface roughness was less than 0.05 microns. The tube coated with the copper film was fired at 900° C. for 30 minutes in an electric furnace and the copper film was fired to form a black cupric oxide film.

The thickness of the film increased to 0.36 microns and the roughness increased to $\pm$ 0.15 microns. The cross-section of the tube coated with the continuous cupric oxide film was the same as in FIG. 3.

Numeral (1) of FIG. 3 corresponds to the transparent tubular fused quartz and (3) corresponds to the cupric oxide film.

The transmittance of the cupric oxide film (thickness: 0.36 microns) in visible and near-infrared was less than 10 percent.

A curled metal wire heater (2) of the FIG. 3 was inserted in the prepared tube and electric power of 400 watts was supplied to the heater.

The surface temperature of the tube measured by the thermograph increases from 400° C. (before coating) to 515° C. (after coating).

EXAMPLE 4

A transparent tubular fused quartz (same size as Example 1) was cleaned by exposure to Freon 113 vapor.

The tube was coated with zirconium oxide in a sputtering apparatus. Namely, the zirconium oxide film was prepared in a dipole high frequency sputtering apparatus the target of which was zirconium oxide ceramic. The distance between the tube and target was 35 cm, the gas pressure was $3\times10^{-2}$ Torr, the gas composition was composed of 70 volume % argon and 30 volume % oxygen and the output power of sputtering was 1 KW. To form a continuous film around the tube, the tube was rotated at the rate of 60 r.p.m. during sputtering.

Furthermore to ensure high-adherence between tube and film, the temperature of the tube was kept at 700° C. during sputtering.

The 0.05 micron zirconium oxide film was prepared by 5-minute sputtering at the sputtering rate of 0.01 micron per minute. The transmittence of the zirconium oxide film (thickness: 0.05 microns) in the visible and near-infrared was less than 15 percent.

A curled metal wire heater (2) of the FIG. 3 was inserted in the prepared tube and electric power of 400 watts was supplied to the heater.

The surface temperature of the tube measured by the thermograph increases from 480° C. (before coating) to 500° C. (after coating).

EXAMPLE 5

A transparent tubular glass-ceramic (same size as Example 2) was cleaned by immersion in trichloroethane and was then withdrawn from the solvent.

The tube was coated with an inorganic paint, being immersed in a solution composed of sodium-silicate and titanium-oxide and being withdrawn from the solution and was fired at 600° C. for 30 minutes in an electric furnace.

The cross-section of the tube coated with the continuous inorganic film of 0.5-micron thickness was the same as in FIG. 2.

The transmittance of the inorganic film (thickness: 0.5 microns) in the visible and near-infrared was less than 10 percent.

A curled metal wire heater (2) of the FIG. 2 was inserted in the present tube and electric power of 400 watts was supplied to the heater.

The surface temperature of the tube measured by the thermograph increases from 485° C. (before coating) to 530° C. (after coating).

We claim:

1. An infrared radiative body which is composed of transparent refractory body and a refractory film thereon which absorbs visible and near-infrared radiation and transmits infrared radiation of wavelength 3~4 microns and the thickness of which is 0.02 to 0.5 microns.

2. The infrared radiative body according to claim 1 wherein the refractory film which absorbs visible and near-infrared radiation and transmits infrared radiation of wavelength 3~4 microns, is an oxide selected from the group consisting of cobalt, copper, iron, nickel, manganese, molybdenum, tungsten, lanthanum, antimony, bismuth, vanadium and zirconium or an aluminum titanate.

* * * * *